United States Patent [19]

McAllister

[11] 3,973,370

[45] Aug. 10, 1976

[54] METHOD OF MAKING A FRAME ASSEMBLY

[76] Inventor: Jack G. McAllister, 2701 N. Douglas Drive, Minneapolis, Minn. 55422

[22] Filed: May 22, 1972

[21] Appl. No.: 255,688

[52] U.S. Cl. ..... 52/745; 52/66; 52/81; 52/86

[51] Int. Cl.[2] ..... E04B 1/32

[58] Field of Search ..... 52/80, 81, 86, 109, 52/745, 66

[56] References Cited

UNITED STATES PATENTS

| | | | |
|---|---|---|---|
| 2,713,774 | 7/1955 | Heintzmann | 52/632 |
| 2,903,856 | 9/1959 | Dean | 52/2 |
| 3,053,351 | 9/1962 | Fulcher | 52/109 |
| 3,126,708 | 3/1964 | Jasper | 52/632 |
| 3,357,142 | 12/1967 | Furrer | 52/2 |
| 3,375,624 | 4/1968 | Mikulin | 52/86 |
| 3,381,923 | 5/1968 | Berry | 52/108 |
| 3,530,622 | 9/1970 | Cohen | 52/86 |
| 3,559,353 | 2/1971 | Partridge | 52/86 |
| 3,710,806 | 1/1973 | Kelly | 52/81 |

FOREIGN PATENTS OR APPLICATIONS

| | | | |
|---|---|---|---|
| 1,394,991 | 3/1965 | France | 52/745 |
| 550,231 | 10/1956 | Italy | 52/86 |

*Primary Examiner*—Ernest R. Purser
*Assistant Examiner*—Henry Raduazo
*Attorney, Agent, or Firm*—Burd, Braddock & Bartz

[57] ABSTRACT

A frame assembly covering an area having expandable struts secured at their ends to connectors. Outer struts are attached to fixed anchors located at the perimeter of the area. The struts have separate members that are moved relative to each other in response to a force, as fluid under pressure or springs, to increase the length of the struts. Contracted struts and connectors are put together on the surface of the area forming a network of struts and connectors. The network may be arranged in regular geometric patterns. The frame assembly is erected by expanding the struts to raise the network of struts and connectors from the surface of the area. The expanded struts are locked to hold the frame assembly in its erected position.

24 Claims, 12 Drawing Figures

METHOD OF MAKING A FRAME ASSEMBLY

BACKGROUND OF THE INVENTION:

Frame assemblies are used to support covering members, as roofs, floors and the like. A conventional frame assembly is assembled piece-by-piece, or in sections, before the covering structure is placed on the frame assembly. In the construction of the frame assembly, upright center supports or temporary scaffolding is necessary to hold the workers and materials. This building procedure requires considerable time and a number of skilled workers. Furthermore, the temporary scaffolding or lift structures must be removed after the frame assembly has been completed.

A geodesic dome has a frame assembly supporting covering panels. The normal procedure in erecting a geodesic dome is to add the panels around the periphery of an initial center section. This center assembly is progressively lifted while additional panels are attached around the periphery by men working at the ground level until all the panels are in place. A center tower rigged with lifting cables and winches is used to lift the geodesic structure progressively. This method requires tower footings to support the entire weight of the dome. These footings are not used after the dome is in place.

Holcombe in U.S. Pat. No. 3,106,772 discloses a method of utilizing pneumatic bags to function as lifting means and temporary scaffolding in the erection of a dome structure. McCracken in U.S. Pat. No. 3,557,515 utilizes air pressure to raise a flexible roof structure which is made rigid after it is in its raised position, thereby forming a self-standing roof structure. McAllister in copending patent application Ser. No. 40,922, now U.S. Pat. No. 3,676,976, describes a method of making a convex structure, as a roof, utilizing a fluid impervious means in combination with cooperating structural means. The structure is set up in ground level position and then raised to a convex curved shape by subjecting the fluid impervious means to fluid under pressure. The curved configuration of the structure is maintained by the cooperating structural means after the fluid has been exhausted from under the fluid impervious means.

SUMMARY OF THE INVENTION

The invention relates to a frame assembly and method of erecting a frame assembly. The frame assembly has struts secured to connectors forming a network of struts and connectors covering an area. The struts each have a first member and a second member which are movable relative to each other to expand the struts in a longitudinal direction. Holding means cooperates with the first member and second member to fix the expanded position of the strut. In terms of method, the network of struts and connectors is assembled on the surface of the area, such as on the ground. Contracted struts are attached to connectors. The outer struts are attached to fixed anchors. The frame assembly is erected by expanding the struts whereby the struts and connectors are raised from the surface of the area covered by the frame assembly. The struts are expanded to elongated positions determined by limit stops on the struts. When the struts have been expanded, the first and second members of each strut can be locked together to provide a rigid strut.

It is an object of the invention to provide a method of erecting a frame assembly, such as roof framing members, in a minimum of time, with a minimum of materials, and with a minimum of labor. Another object of the invention is to provide a frame assembly that is set up in a generally horizontal position and is subjected to forces to self raise to an elevated or erected position. A further object is to provide a method of erecting a frame assembly over a surface that does not require temporary scaffolding nor lifting machinery to elevate the frame assembly over the surface.

IN THE DRAWINGS

Figure 1:
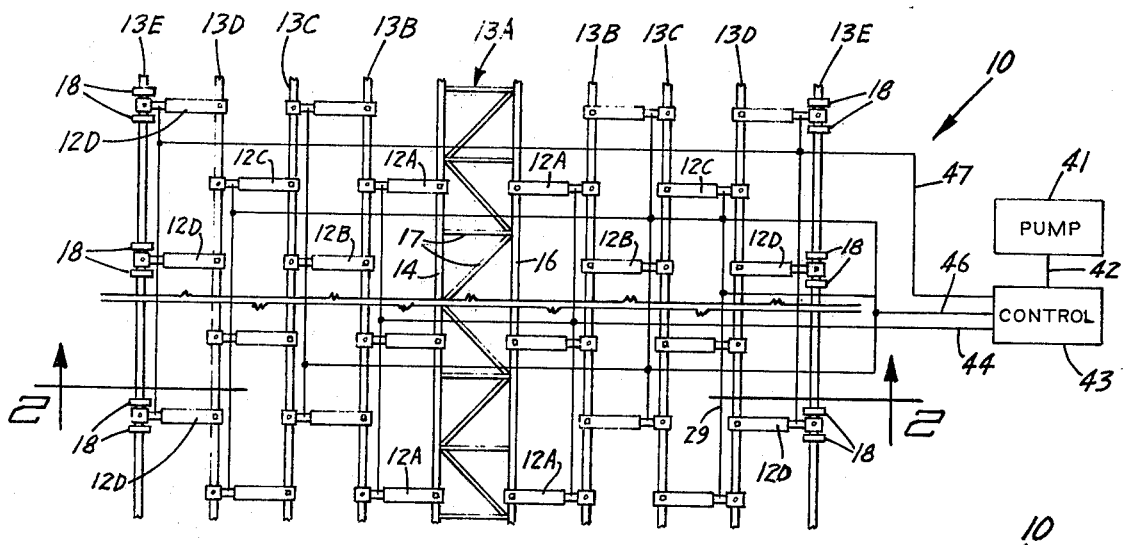
FIG. 1 is a fragmentary portion of a top plan view of the frame assembly of the invention in its initial or ground position.
Figure 2:
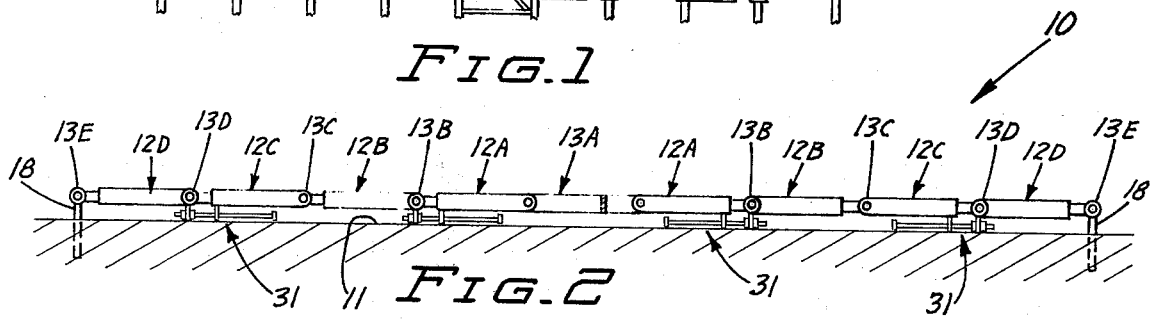
FIG. 2 is an enlarged sectional view taken along line 2—2 of FIG. 1.

Referring to the drawings, there is shown in FIGS. 1 to 4, a frame assembly indicated generally at 10 covering a surface 11 of an area of the ground, or a surface bordered by a foundation or the like. Surface 11 is a plane surface. Frame assembly 10 has a plurality of extendible members or struts 12A, 12B, 12C and 12D arranged in generally parallel alignment. Connectors or rigid members 13A, 13B, 13C, 13D and 13E are operably coupled to the extendible struts 12A through 12D to form a generally rectangular network or pattern of struts and connectors covering the surface 11. Connectors 13A through 13E are rigid, elongated runners or rods. The adjacent connectors are located in generally parallel relationship with each other and are fixed or non-rotatably joined to the ends of the extendible struts. The center connector 13A is of a rigid frame construction comprising a pair of elongated side members or rods 14 and 16. Cross bracing 17 secured to rods 14 and 16 holds the rods in spaced relationship. Connector 13A can be replaced with a single rigid rod connector. The outer or side connectors 13E are located at the outside edges of the surface 11 and are pivotally connected to anchors 18. Connectors 13B, 13C and 13D are positioned between center connector 13A and outside connector 13E, as shown in FIG. 1. The struts are located in longitudinal rows between the connectors. Struts 12A are secured to connectors 13A and 13B. Strust 12B are secured to connectors 13B and 13C. Sruts 12C are secured to connectors 13C and 13D. Anchored or outside struts 12D are pivotally connected to connectors 13D and 13E. Outside struts 12D can be rigid members or links having a fixed length. These members can be pivotally connected to anchors or a foundation along the sides of the surface 11.

The outside extendible struts 12D are pivotally connected to anchors 18 secured to the surface 11. Anchor means 18 are a plurality of members that extend downwardly into the surface 11 forming a fixed holding means for the frame assembly 10. The upper ends of anchor means 18 project upwardly from surface 11 and have holes for pivotally accommodating the outer connectors 13E. Connectors 13E are elongated members such as rods or tubes which extend through the openings in the anchor means 18 and are pivotally joined to the outer extendible struts 12D. As shown in FIG. 1, pairs of anchor means 18 are located on opposite sides of the outer portion of the extendible struts 12D to provide hinge connections between the anchor means 18 and the extendible struts 12D. The portions of the connector members 13A between adjacent pairs of anchoring means can be removed. Alternatively, the struts 12D can be connected directly to the anchors 18. The anchor means can be part of a foundation along the sides of the surface 11.

Figure 5:
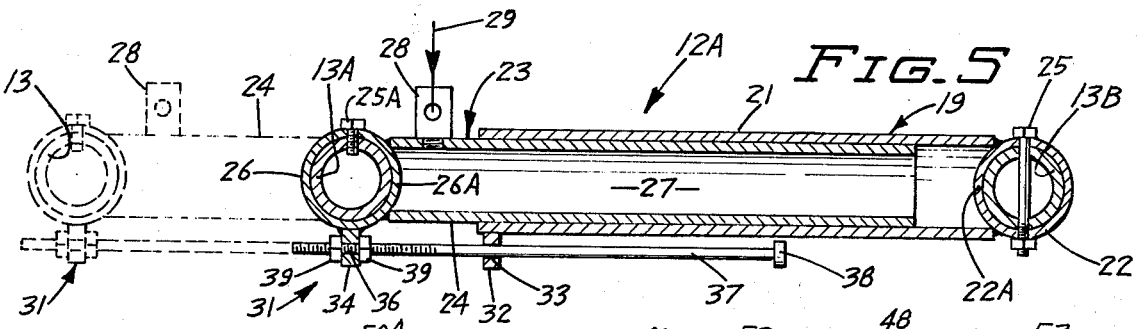
FIG. 5 is a longitudinal sectional view of one longitudinal extendible strut means of the frame assembly of FIG. 1.

Referring to FIG. 5, there is shown the details of extendible strut 12A connected to spaced connectors 13A and 13B. Struts 12B–D are identical. The following description is limited to strut 12A.

Strut 12A is shown in FIG. 5 in full lines in its contracted position and in broken lines in its extended position. Strut 12A has a first member indicated generally at 19 cooperating with a second member indicated at 23 to provide a longitudinally extendible strut. The first member 19 has an elongated cylinder or sleeve 21 connected to a transverse collar or ring 22. Collar 22 has a portion 22A that closes the end of cylinder 21. The collar 22 is positioned around and fixed to the connector member 13B with a bolt 25. The second member 23 has an elongated cylinder or sleeve 24 telescopically mounted within cylinder 21. The outer end of cylinder 24 is attached to a transverse collar or ring 26. Collar 26 has a portion 26A that closes the outer end of cylinder 24. Collar 26 is positioned around and fixed to connector member 13A with bolt 25A. Other structures, as welds, keys, and the like, can be used to attach the ends of the struts to the connectors.

The cylinders 21 and 24 have a common chamber 27 for receiving a fluid, as air or water, under pressure whereby the cylinders 21 and 24 move outwardly relative to each other to form a piston and cylinder arrangement to expand or elongate the member 12A. The fluid is introduced into chamber 27 through a coupling 28 attached to cylinder 244 and a fluid carrying line 29.

The extent of elongation of the cylinders 21 and 24 relative to each other is controlled with a limit stop indicated generally at 31. Stop 31 comprises a first tab 32 secured to cylinder 21. Tab 32 has a longitudinal hole 33. A second tab 34 is secured to collar 26. Tab 34 has a hole 36 in general longitudinal alignment with hole 33. An elongated rod 37 slideably extends through hole 33 and is connected to tab 34. Rod 37 has a head 38 engageable with tab 32 to limit the maximum open or expanded position of cylinders 21 and 24. The opposite end of rod 37 carries nuts 39 which adjustably secure the rod to the tab 34. Nuts 39 are adjustable whereby the length of rod 37 cooperating with tab 32 can be adjusted, thereby adjusting the expanded length of the strut. Other types of stop structures can be used to limit the expansion of the struts. The stop structure can be located within the struts.

Returning to FIG. 1, the fluid under pressure is supplied to the extendible struts 12A–D by a pump 41. Pump 41 is connected by line 42 to a control 43, such as an array of valves. A first line 44 couples the control 43 with the extendible strut 12A connected to connector 13A. A second line 46 is connected to the intermediate rows of extendible struts 12B and C. A third line 47 is connected to the outermost rows of extendible struts 12D. Control 43 is operable to selectively or simultaneously direct fluid under pressure to the struts 12A–D.

Figure 6:
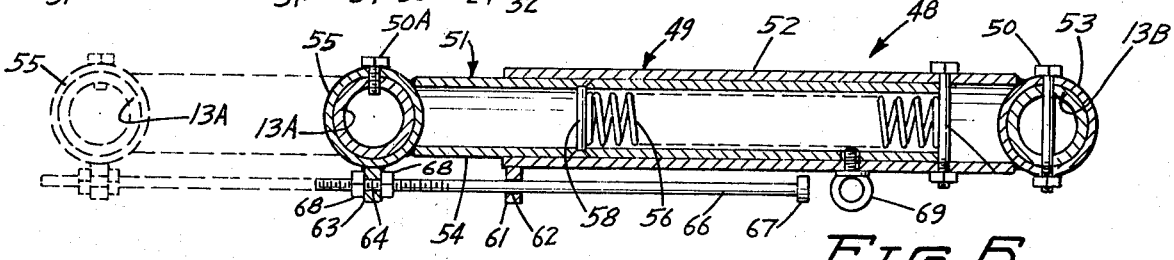
FIG. 6 is a view similar to FIG. 5 of a modification of a longitudinal extendible strut means usable in the frame assembly of the invention.

Referring to FIG. 6, there is shown a mechanically biased extendible member or strut indicated generally at 48 that can be used in the frame assembly 10. Strut 48 has a first member 49 and a second member 51 movably arranged relative to each other to provide an expandable and extendible strut for the frame assembly. The first member 49 has a cylinder or sleeve 52 secured to a transverse collar or ring 53. The ring is positioned around and fixed to the connector member 13B with bolt 50. The second member 51 has an elongated cylinder or sleeve 54 secured to an end collar or ring 55. Ring 55 is positioned around and fixed to connector member 13A with bolt 50A. Located within cylinder 54 is an elongated expandable coil spring 56. One end of spring 56 abuts against a transverse bolt 57 mounted on the cylinder 52. The opposite end of spring 56 abuts against a transverse pin 58 mounted on the cylinder 54. The spring 56 is held in a compressive state between the pins 57 and 58 whereby the strut 48 is preloaded. A holding pin 69 extended through holes in the cylinders 52 and 54 maintains the strut in the preloaded condition.

The strut 48 has stop means for limiting its elongation indicated generally at 59. Stop means 59 is similar in construction to stop 31 shown in FIG. 5. Stop means 59 has a first tab 61 secured to cylinder 52 having a hole 62. A second tab 63 secured to collar 55 has a hole 64. A rod 66 is located in holes 62 and 64. Rod 66 has a head 67 engageable with tab 62 to limit the outward relative movement of cylinders 52 and 54. Nuts 68 threaded on rod 66 engage opposite sides of the tab 63 to adjustably position the rod relative to tab 63.

In use, the expansion of strut 48 is achieved by removal of holding pin 69. This permits the spring 56 to expand, thereby forcing the adjacent connector members 13A and 13B away from each other.

Figure 7:
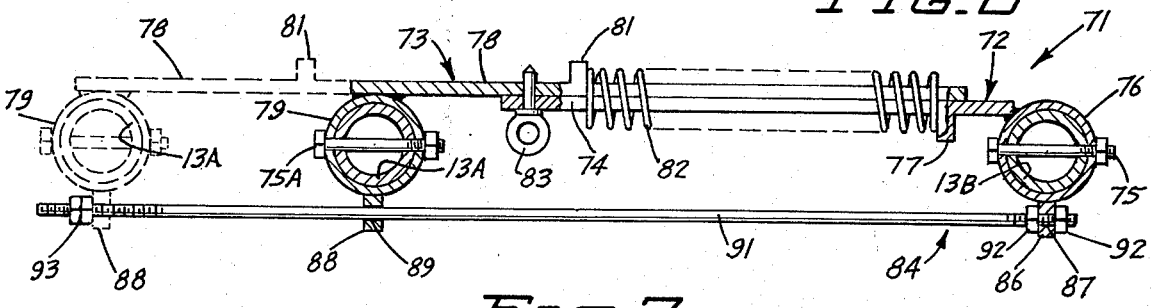
FIG. 7 is a view similar to FIG. 5 of another modification of a longitudinal extendible strut means usable in the frame assembly of the invention.

Referring to FIG. 7, there is shown a further modification of the extendible member or strut indicated generally at 71. Strut 71 has a first member 72 movably associated with a second member 73 providing an expandable strut between adjacent connector members 13A and 13B. The first member 72 has an elongated bar 74 secured at one end to a transverse collar or ring 76. Collar 76 surrounds connector member 13B and is secured thereto with bolt 75. Extended downwardly from the bottom of member 72 adjacent collar 76 is a short shoulder or lug 77. Second member 73 is an elongated bar 78 positioned in alignment with and over the bar 74. The outer end of bar 78 is secured to transverse collar or ring 79 mounted on the connector 13A. Bolt 75A attaches ring 79 to connector 13A. Bar 78 has an upwardly directed shoulder or lug 81 providing a stop for one end of a coil spring 82. The opposite end of spring 82 bears against lug 77 on the bar 74. Spring 82 is in a compressive state between the lug 77 and lug 81. A pin 83 extended through holes in bars 74 and 78 maintains the plates in a fixed position relative to each other and the spring in a compressive state. Spring 82 surrounds the bars 74 and 78 thereby holding the bars adjacent each other.

In use, pin 83 is removed so that the expansion force of spring 82 will move the bars relative to each other. The movement caused by spring 82 is limited by a stop means indicated generally at 84. Stop means 84 has a first tab 86 secured to collar 76. Tab 86 has a hole 87 for accommodating a portion of rod 91. A second tab 88 is secured to collar 79. Tab 88 has a hole 89 for slideably accommodating rod 91. A pair of nuts 92 located on opposite sides of tab 86 are threaded on rod 91 to secure the rod to the tab. The opposite end of rod 91 carries a pair of nuts 93 forming limit abutments which are engageable with tab 88 to limit the elongation or expansion of strut 71.

The process of making and erecting the frame assembly 10 is shown in FIGS. 1 to 4. The sizie of the frame assembly is determined by measuring and laying out the area to be covered by the assembly. The anchors 18 are placed in a foundation or other secure structure around the outer perimeter of the area or surface 11 to be covered by frame assembly 10. Extendible struts 12A–D and connectors 13A–E are arranged in generally rectangular pattern, as shown in FIG. 1, on the surface 11. The outer connectors 13E are pivotally attached to the anchors 18 and to the outer ends of struts 12D. The network or pattern of struts and connectors is completed by attaching the struts 12A–D to connectors 13A–E with bolts 25 and 25A. The inner struts 12A have ends or collars 26 connected to the central connector 13A. The entire framework is assembled in a flat condition on surface 11, as the ground, with the struts 12A–D in their contracted positions. The pump 41 is operable to supply fluid under pressure to control 43. Control 43 is used to selectively direct the fluid under pressure to progressively expand the rows of extendible struts 12A–D. The center connector 13A is initially raised by expanding the struts 12A connected thereto. The fluid is supplied to these struts 12A via line 44 to expand the struts.

As the frame assembly is elevated, the connectors are subjected to twisting or torsion forces. These torsion forces act against the force of the air pressure thereby keeping the frame assembly in its pattern and controlling the curvature of the erected frame assembly. The struts 12A–D are also subjected to bending forces. They flex to a convex curved shape as the frame assembly is being erected. The control is then operated to provide fluid under pressure to line 46 while maintaining the fluid under pressure in line 44. The fluid under pressure in line 46 will expand the second and third rows of struts 12B and 12C whereby the mid-portion of the framework is elevated. The final erection of the framework is achieved by applying fluid under pressure to line 47 to expand the end struts 12D. The fluid under pressure will hold all of the struts 12A–D in an arcuate position against the biasing forces of the connectors 13A–D and struts 12A–D, as shown in Fig. 3 to enclose a space 94 over the surface 11.

Figure 3:
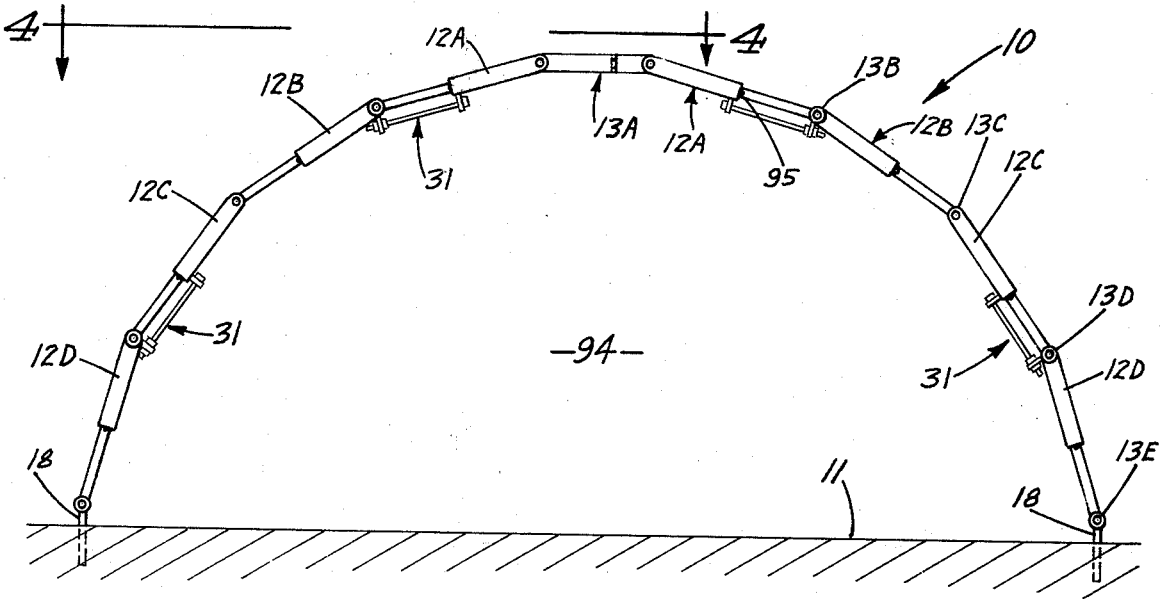
FIG. 3 is a side elevational view of the frame assembly of FIG. 1 in the erected position.
Figure 4:
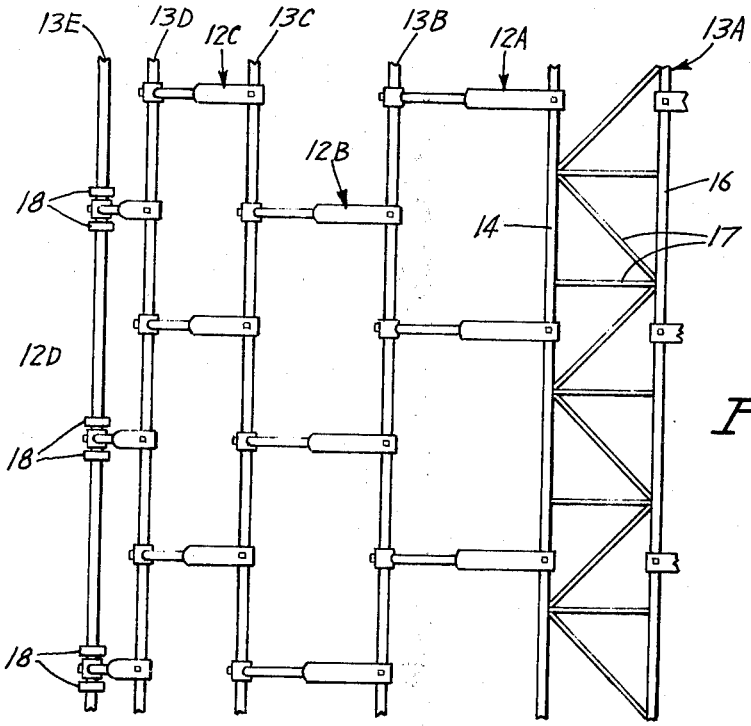
FIG. 4 is a top plan view taken along line 4—4 of FIG. 3 looking in the direction of the arrows.

The arcuate shape of the frame assembly is maintained by securing the first and second members of the struts together, such as by weld 95, shown in FIG. 3. After this is done, the fluid under pressure can be released from the system. The fluid lines 44, 46 and 47 can be removed. The framework can then be enclosed with a cover, such as plastic sheet material, concrete or other rigid construction materials. Mechanical structures, such as stops, pins and collars can be used to prevent relative movement of the first and second members of each strut. Also, the struts can be progressively filled with a foamed plastic, such as polyurethane or polystyrene, which will prevent collapse of the erected and expanded struts. The foam plastic can be such that it can be foamed in place within the chamber 27 when the members 21 and 24 shown in Fig. 5 are in the expanded position. Alternatively the resins and foaming agents can be located in or injected into the chambers of the contracted struts. The struts can be extended with the pressure generated by the chemical or foaming reaction of a chemical mixture as plastic resins with foaming agents or chemical blowing agents.

Struts 12 in each row can have varying lengths and thereby change the shape of the final frame assembly. Also, the amount of expansion or longitudinal extension of the extendible struts will determine the final shape of the frame assembly. All of the struts are usable to provide a self-raising frame assembly that is constructed on the ground or on a surface accessible to workers. The construction of the frame assembly is done without supporting framework and with a minimum of time, parts and labor.

The extendible struts 48 and 71 can be used to erect the frame assembly 10. These struts utilize the biasing force of the compression springs 56 and 82, respectively, to expand or extend the struts. The lock pins associated with these struts are removed, whereby the struts will expand and erect the frame assembly. Pins 69 and 83, as shown in FIGS. 6 and 7, can be removed by use of cords or other mechanical structures sufficient to apply a force on the pins. The cords can be interlinked so that the expansion of the center rows of struts will release the pins from the intermediate struts, thereby progressively raising the framework from the surface 11. The frame assembly will be maintained in its erected position by the biasing force of the expansion springs. Additional locking structure, as welds, stop pins and the like, can be utilized to fix the extended positions of the struts. Also, the struts can be designed so that the expansion springs can be removed and reused in subsequent frame assemblies.

Referring to Figs. 8 to 11, there is shown a frame assembly indicated generally at 100 for enclosing a circular surface 101. When frame assembly 100 is in its raised or erected position, it forms a dome-like framework over surface 101. Surface 101 is surrounded by an annular ring or foundation 102. Located around the surface adjacent foundation 102 are anchors 103 embedded in the floor forming surface 101. Anchors 103 can be secured to foundation 102 or be part of foundation 102.

Figure 8:
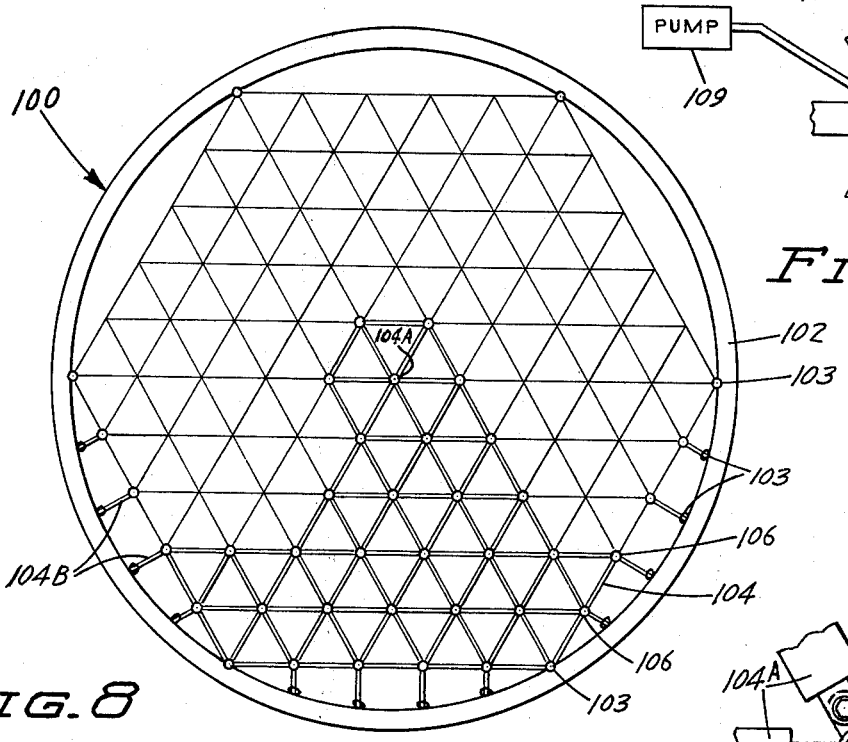
FIG. 8 is a diagrammatic plan view of a dome shaped frame assembly of the invention.
Figure 11:
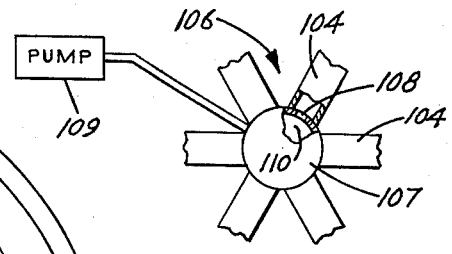
FIG. 11 is a top plan view of the strut means secured to a connector of the frame assembly.

Frame assembly 100 comprises a plurality of triangularly arranged extendible members or struts 104. Each strut 104 has ends connected to connectors or hubs 106 to form an interconnected network, as shown in FIG. 8. The outermost or outer peripheral struts 104B can be rigid members or links of varying lengths that are pivotally connected to the foundation or anchors adjacent the foundation.

Connector 106 comprises a cylindrical housing 107 enclosing a chamber 110. The ends of cylinder struts 104 are secured to circumferential spaced portions of the side wall of housing 107. Passages 108 in side wall 107 provide communication between the chamber and the insides of struts. Air is supplied to the chamber with a pump 109 or any other source of air under pressure.

Figure 12:
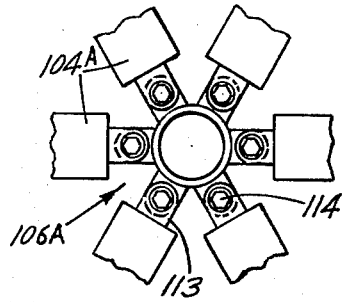
FIG. 12 is a top plan view of a modified connector attached to strut means of the frame assembly.

An exmaple of a modification of the connector is shown in FIG. 12 and identified at 106A. Connector 106A has a cylindrical body 111. A plurality of pairs of outwardly directed ears 112 are secured to the outer side of body 111. Connector 106A has six pairs of ears 112 equally spaced around the outer circumferential face of the body 111. Each ear of each pair of ears is spaced from the other a distance to receive a rib or projection 113 extended from the base or end of the adjacent extendible strut 104A. Bolts 114 pivotally connect the projection to the ears whereby the struts can pivot about axes generally transverse to the longitudinal axis of the struts.

The extendible struts 104 have the same structures as the struts shown in FIGS. 5, 6 and 7. Each strut has a first member movably located relative to a second member. A limit stop is used to limit the expanded position of the members. The strut can be expanded in response to fluid under pressure or springs and held in an expanded position in a manner as described with regard to struts 12A, 48 and 71 in FIGS. 5, 6 and 7. The expandable struts can have different lengths to provide for different types of contours of the erected frame assembly.

Figure 9:
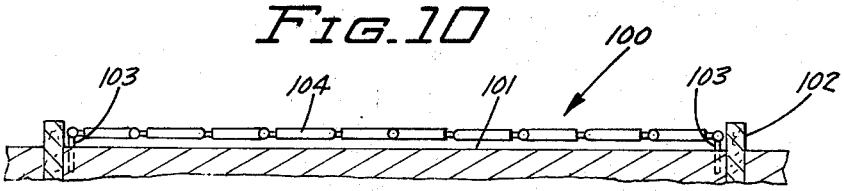
FIG. 9 is a sectional view taken along line 9—9 of FIG. 8 showing the frame assembly in its initial or ground position.

The fabrication and erection of frame assembly 100 is substantially the same as the frame assembly 10 shown in FIGS. 1 to 4. Initially the area to be covered by the frame assembly is laid out and surrounded by the foundation 102. The connectors 106 are laid out on the surface 101 in a generally triangular pattern. The struts 104 are secured to the connectors 106 while they are in their contracted positions. This is done in the ground level or horizontal position, as shown in FIG. 9. The outer peripheral struts are connected adjacent the foundation to the anchors 103.

Figure 10:
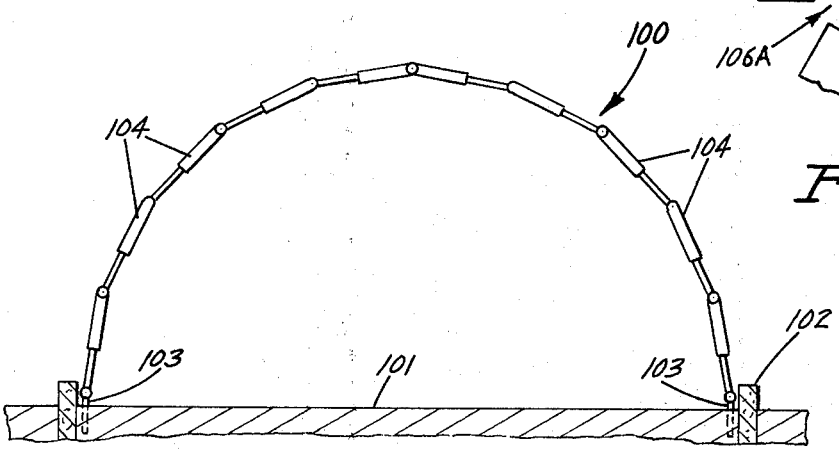
FIG. 10 is a sectional view similar to FIG. 9 showing the frame assembly in the erected position.

The constructed frame assembly is then erected by expanding the struts 104 to form an arcuate or dome-shaped frame assembly, as shown in FIG. 10. All of the struts 106 are expanded together as they are in fluid communication with each other through connector housings 107. Pump 109 is operable to supply air to one of the housings. This air will expand all the struts 106 to erect the frame assembly. As the frame assembly is elevated, the connectors 107 and struts 104 are subjected to bending forces which act to bias the frame assembly in a downward direction. The biasing force due to the flexing of the connectors 107 and struts 104 acts against the force raising the frame assembly to control the curvature of the erected frame assembly. The struts 104 can be expanded in response to a fluid under pressure, as air or water, in a manner as shown in FIG. 1, by selectively closing some of passages 108. Alternatively, springs or similar biasing members can be used to expand the struts. The struts can be progressively expanded from the center connector 104A whereby the frame assembly 100 will sequentially raise as the struts are progressively elongated as a function of the distance from the center of the frame assembly. The struts 104 will continue to expand until the limit stop associated with each strut determines the full length of the expanded strut. The struts may then be secured together to form rigid struts for the frame assembly 100.

Frame assembly 100 is assembled on the surface 101 and is self-lifting in response to expansion forces on the struts. This eliminates the necessity of separate rigging and lifting structures as well as temporary scaffolding.

The embodiments of the invention in which an exclusive property or privelege is claimed are defined as follows:

1. A method of making a frame assembly over a surface comprising: arranging on the surface a plurality of struts, some of the struts being outer struts, each strut having a first member extended in a longitudinal direction and a second member extended in the longitudinal direction of the first member, said first and second members being longitudinally movable along the longitudinal direction of the first and second members relative to each other to increase the longitudinal length of the strut, said first member and second member each having ends, attaching the ends of said first member to first connector means, attaching the ends of the second member to second connector means, said second connector means being spaced from and only connected to the first connector means with the struts, anchoring the outer ends of the first members of the outer struts, elongating the struts by longitudinally moving the first and second members relative to each other whereby said struts and first and second connector means move away from the surface erecting the frame assembly over the surface, and holding the struts in their elongated positions.

2. The method of claim 1 wherein: the struts are arranged in a generally rectangular pattern and are attached to elongated first and second connector means.

3. The method of claim 1 wherein: the struts are arranged in a generally triangular pattern whereby the erected frame assembly has a dome shape.

4. The method of claim 1 wherein: the struts are arranged generally parallel to each other and the first and second connector means are elongated rigid members located generally transverse to the elongated means.

5. The method of claim 1 wherein: the outer ends of the first members of the outer struts are pivotally attached to fixed anchor means.

6. The method of claim 1 wherein: the struts in the center of the surface are elongated first and the remainder of the struts are progressively longitudinally elongated as a function of the distance from the center of the surface.

7. The method of claim 1 wherein: all the struts are longitudinally elongated at substantially the same time.

8. The method of claim 1 wherein: the struts are elongated with air under pressure acting on the first and second members.

9. The method of claim 1 wherein: the struts are elongated in response to pressure by the foaming reaction of a chemical mixture.

10. The method of claim 1 wherein: the struts are held in the elongated positions by locking the first and second members together.

11. The method of claim 1 wherein: the connector means flex during the elongation of the first and second members thereby providing a biasing force controlling the curvature of the erected frame assembly.

12. The method of claim 1 wherein: the struts flex during the elongation of the elongated means thereby providing a biasing force controlling the curvature of the erected frame assembly.

13. The method of claim 1 wherein: the connector means and struts flex during the elongation of the first and second members thereby providing a biasing force controlling the curvature of the erected frame assembly.

14. A method of making a frame assembly over a surface comprising: arranging a plurality of linear means on the surface, some of said linear means being outer means, each of said linear means having a longitudinal length, each of said linear means comprising first longitudinally elongated means and second longitudinally elongated means, said first longitudinally elongated means being slidably mounted on the second longitudinally elongated means for longitudinal movement along the longitudinal length of the linear means to increase the length of the linear means, mounting portions of the first longitudinally elongated means on a first connector means, mounting portions of the second longitudinally elongated means on a second connector means, said second connector means being independently movable of and only connected to the first connector means with the linear means, anchoring portions of the outer linear means to a fixed support, longitudinally moving the first longitudinally elongated means and the second longitudinally elongated means relative to each other to increase the length of the linear means thereby moving the first and second connector means away from each other and away from the surface to erect the frame assembly over the surface, and holding the first longitudinally elongated means and second longitudinally elongated means in the longitudinally extended positions.

15. The method of claim 14 wherein: the linear means are arranged on the surface in a generally rectangular pattern.

16. The method of claim 14 wherein: the first and second connector means are elongated members arranged generally parallel to each other and generally normally disposed to the linear means.

17. The method of claim 14 wherein: The linear means are arranged in generally triangular patterns whereby the erected frame assembly has a dome shape.

18. The method of claim 14 wherein: the portions of the outside linear means are anchored by pivotally connecting said portions to a fixed anchor means.

19. The method of claim 14 wherein: the linear means at the center portion of the surface are initially longitudinally elongated and the remainder of the linear means are progressively longitudinally elongated as a function of the distance from the center portion of the surface.

20. The method of claim 14 wherein: all the linear means are longitudinally elongated at substantially the same time.

21. The method of claim 14 wherein: the linear means are elongated in response to air under pressure acting on the first means and second longitudinally elongated means.

22. The method of claim 14 wherein: the first longitudinally elongated means and second longitudinally elongated means are longitudinally elongated in response to expansion and pressure of a foaming reaction of a chemical mixture.

23. The method of claim 14 wherein: the first longitudinally elongated means and second longitudinally elongated means are held in the longitudinal extended position by locking the first longitudinally elongated means to the second longitudinally elongated means.

24. The method of claim 14 wherein: the first longitudinally elongated means and second longitudinally elongated means are longitudinally elongated relative to each other with a biasing means acting on the first longitudinally elongated means and second longitudinally elongated means.

* * * * *

UNITED STATES PATENT AND TRADEMARK OFFICE

CERTIFICATE OF CORRECTION

PATENT NO. : 3,973,370

DATED : August 10, 1976

INVENTOR(S) : Jack G. McAllister

It is certified that error appears in the above-identified patent and that said Letters Patent are hereby corrected as shown below:

Column 3, line 2, "Strust" should be --Struts--.

Column 3, line 3, "Sruts" should be --Struts--.

Column 3, line 58, "244" should be --24--.

Column 5, line 26, "sizie" should be --size--.

Column 7, line 10, "exmaple" should be --example--.

Column 8, line 10, "privelege" should be --privilege--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*